US010074228B2

(12) United States Patent
Anand

(10) Patent No.: US 10,074,228 B2
(45) Date of Patent: Sep. 11, 2018

(54) AUTOMATED VERIFICATION OF OPTICAL RANDOMNESS IN SECURITY LABEL

(71) Applicant: Ashish Anand, Bangalore (IN)

(72) Inventor: Ashish Anand, Bangalore (IN)

( * ) Notice: Subject to any disclaimer, the term of this patent is extended or adjusted under 35 U.S.C. 154(b) by 0 days.

(21) Appl. No.: 15/316,847

(22) PCT Filed: Jun. 9, 2015

(86) PCT No.: PCT/IB2015/054342
§ 371 (c)(1),
(2) Date: Dec. 7, 2016

(87) PCT Pub. No.: WO2015/189764
PCT Pub. Date: Dec. 17, 2015

(65) Prior Publication Data

US 2017/0116809 A1 Apr. 27, 2017

(30) Foreign Application Priority Data

Jun. 9, 2014 (IN) ..... 2822/CHE/2014

(51) Int. Cl.
*G07D 7/202* (2016.01)
*G07D 7/1205* (2016.01)
*B42D 25/328* (2014.01)

(52) U.S. Cl.
CPC ..... *G07D 7/205* (2013.01); *B42D 25/328* (2014.10); *G07D 7/1205* (2017.05)

(58) Field of Classification Search
None
See application file for complete search history.

(56) References Cited

U.S. PATENT DOCUMENTS 9,361,532 B2 6/2016 Anand
2013/0008962 A1* 1/2013 Anand ..... G06K 7/10 235/454
2013/0306737 A1* 11/2013 Freeman ..... G06K 19/06037 235/488
2014/0218734 A1* 8/2014 Shimaoka ..... G07D 7/121 356/369

OTHER PUBLICATIONS

U.S. Appl. No. 14/252,392, filed Aug. 7, 2014, Linksmart Technologies PVT. L.
U.S. Appl. No. 13/521,733, Ashish Anand.
U.S. Appl. No. 13/590,871, filed Jan. 10, 2013, Ashish Anand.

* cited by examiner

*Primary Examiner* — Shawn DeCenzo

(57) ABSTRACT

This invention proposes a per-piece unique optical randomness on security labels that enables a unique color profiling. Verification of Color-profiling is fully automated. Color profiling is captured under a light homogenizer. Color profiling starts at certain intersection point (within security label) of line joining reference circle to centre of security label. To detect duplication, multiple color-profiles are acquired with scanner flash light switched-on & switched-off. Even if same label is reapplied after tampering the asset the color profiling gets auto changed and can be automatically verified. Color profiling based security is layered on fundamental layer of spatial orientation. Also optically variable region can be leveraged to quickly verify if label is original without matching with stored color profile in cloud during registration scan.

14 Claims, 7 Drawing Sheets
(6 of 7 Drawing Sheet(s) Filed in Color)

Color profile has spatial orientation with respect to the external reference. Hence, even if the same label is re-applied, the spatial orientation of the color profile changes with respect to the external reference Scanning device Color profile has spatial orientation with respect to the external reference. Hence, even if the same label is re-applied, the spatial orientation of the color profile changes with respect to the external reference Color profiling is carried out along a virtual path, shown as a ring (for illustration) of specific diameter and co-axial to the label Matching of color profiling of same label during registration (left) and verification (right)

Light homogenizer enclosure through which mobile scanner acquires imaging of color variable label through the hole of the homogenizer Original label changes its color profile between light-off (illumination of scanning device) and light-on (illumination of scanning device)

Duplicate label color profile not changing with light-off (illumination of scanning device) and light-on (illumination of scanning device)

Original label getting brighter and darker in different portions when scanning device is kept tilted (non-parallel to label surface) with light-on (illumination of scanning device)

AUTOMATED VERIFICATION OF OPTICAL RANDOMNESS IN SECURITY LABEL

BACKGROUND

Disclosed is a novel form of automated verification of optical randomness on security labels. Optical variableness and color shift is an existing and well known practice for originality verification of holographic security stickers. Obvious security leaks present in this method is that firstly these are not machine verified and automated, secondly there is no per-piece unique verifiable optical randomness and thirdly there is no differentiation, if same or another genuine sticker is reapplied.

LIMITATION OF PRIOR-ART:

Security labels as disclosed in Indian application 4781/CHENP/2012 and U.S. Pat. 8,740,076 B2 provides proof of tampering based on spatial orientation of label with auto-acquired credential with respect to external reference. However, label along with external reference can be copied by photocopy scan, resulting in duplication of spatial orientation, thereby defeating the purpose. Further though optical variableness and color shift is also mentioned in these prior-arts, disclosure fails to teach how the optical variableness can be automated to enable reliable machine verification and linking of automation of optical variableness with fundamental layer of spatial orientation.

SUMMARY

This invention will be exercised on security label with optically random region (ORR) which is also visibly variable when seen from different angles and in different lighting. Invention proposes the automated method that includes capture of color-profile and then comparison of those, between registration and verification scans. During time of registration Scanning device (not limited to smartphone or industrial PDA) captures the picture of optically variable smartDNA security labels along with external reference (that is also used to determine the spatial orientation of security label) and this picture is compared with that captured during time-of-verification. Though this invention is described in light of security labels as disclosed in mentioned prior-arts in previous section but it can be exercised with other kind of labels as well without any undue experimentation.

BRIEF DESCRIPTION OF THE DRAWINGS

The patent or application file contains drawings executed in color. Copies of this patent or patent application publication with color drawings will be provided by the Office upon request and payment of the necessary fee.

DETAILED DESCRIPTION

Snap of optically variable label is always captured along with external reference. External reference (001) is used to determine spatial orientation of security label. Snap can also be captured using a light homogenizer enclosure to protect the optical variableness from external lighting. In first embodiment, color profiling of snaps captured at registration and verification time is compared. Color profiling may be taken only for a specified area (for example virtual ring/path/contour within security label as shown by 002 and 004) of specified thickness and distance from centre of label. However, important point is that color profiling always starts getting recorded from selected point. For example, selected point can be on perimeter of ring and intersection point of line joining the reference circle to centre of label. Also, once intersection point (010 and 003) is selected then color profiling progresses in specific direction (for example clockwise or anti-clockwise). For color profiling (005 and 006) certain number of points on perimeter of ring is selected and on each point average color profile of small area (for example circle/square) considering the point as centroid of area. In this invention, color profiling is captured in form of rectangle with bars of color and each bar represents color value at points selected on virtual ring (002 and 004) traversed.

There is significant importance of starting color profiling at intersection point (on ring circumference) of line joining the external reference to centre of security label. Tamper detection based on spatial orientation might fail, if hypothetically external reference is tampered in a specific way such that computation of spatial orientation of label is not affected, but then, also the color profiling of same genuine label even though not physically tampered will get changed indicating tampering. Color profiling of same label will be changed because intersection point on circumference of ring will be different with changed position of external reference.

Figure 1:
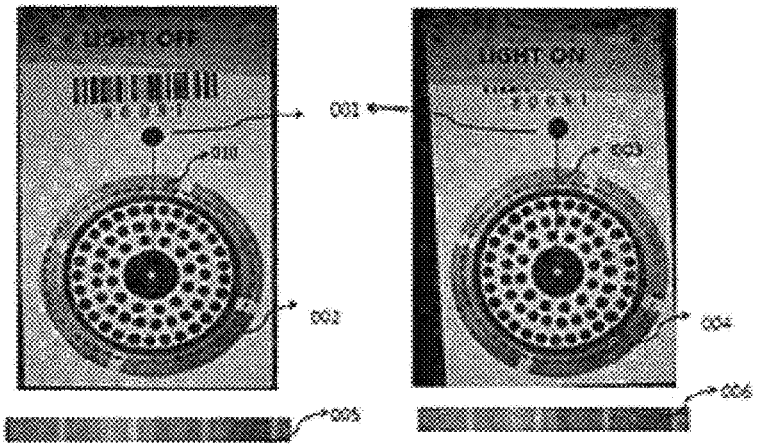
FIG. 1 shows scans of color-variable labels and color-profiler extracted starting at intersection point with respect to external reference and traversing along the virtual ring/path/contour in ORR area (circular ring towards label periphery).
Figure 2:
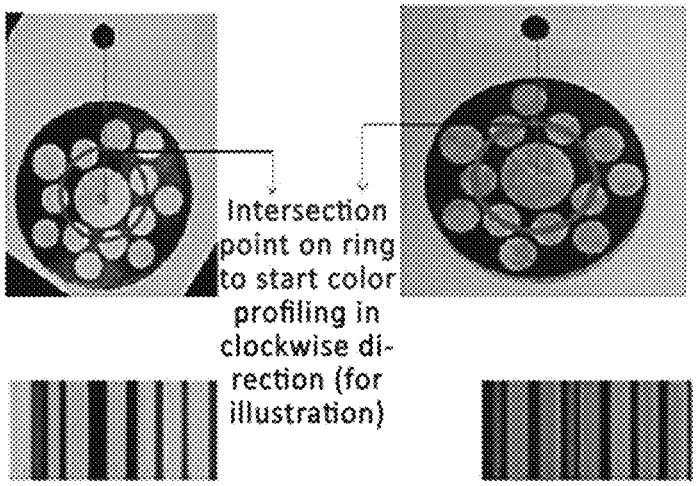
FIG. 2 shows color profiler extraction as described in FIG. 1 but ORR region in full label area.
Figure 3:
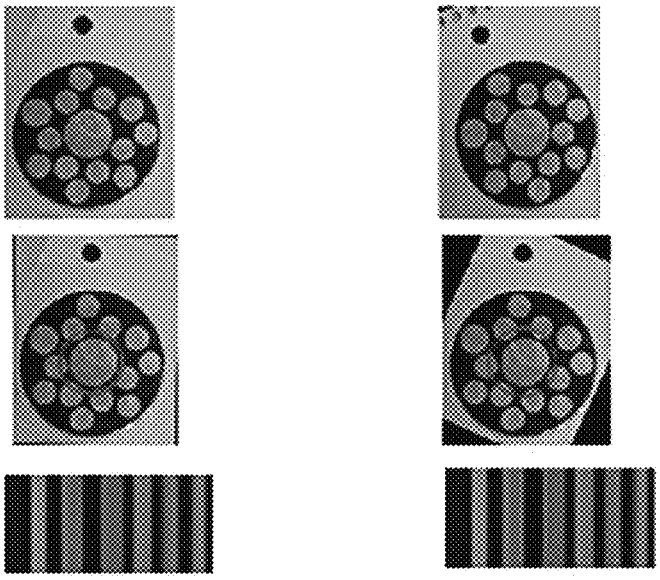
FIG. 3 shows the color profiling of same label, which matches exactly as shown in FIG. 2.
Figure 4:
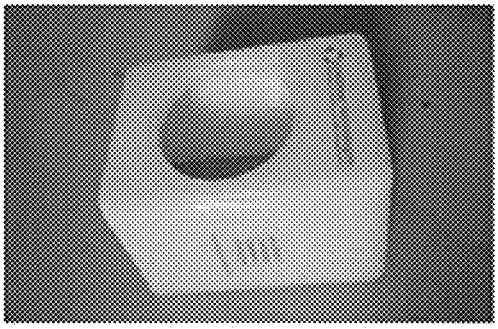
FIG. 4 shows light homogenizer as an optional accessory.
Figure 5:
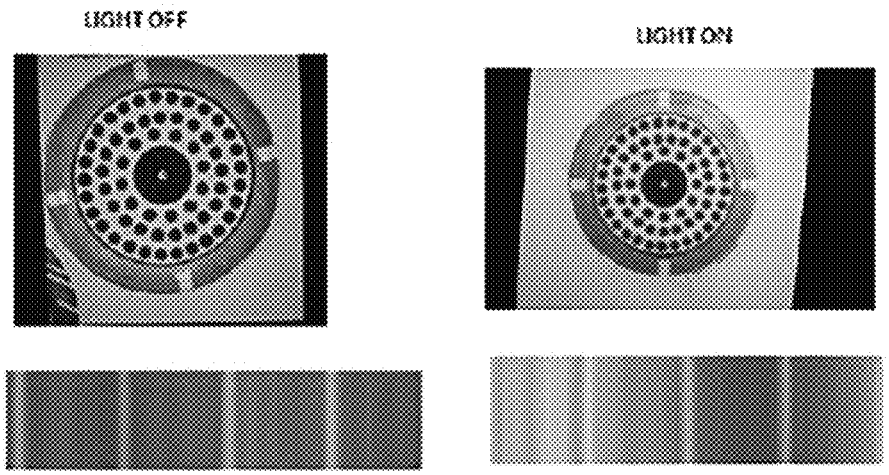
FIG. 5 shows color profiles of original label gets changed variable with flash ON & FLASH OFF.
Figure 6:
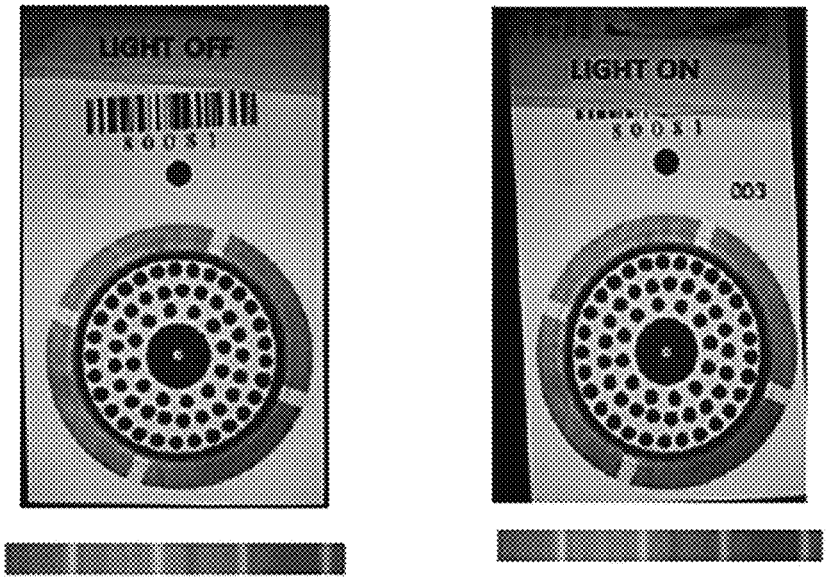
FIG. 6 shows label imaging for duplicate label (photocopy or scan) color profiling remains same without any change with light ON and light OFF during forensic verification.

Another possible threat can be exercised by hacker is about, substituting photocopy/scanned version of label having same color randomness as of original label with actual optical variable region. However, in duplicate version the color effect will not be variable due to change in angle of lighting. it is challenging to do automated detection and concluding that the label being scanned is with actual optical variable device. Challenge in automated verification is that color randomness will be variable depending on orientation & tilt of smartphone with respect to label being scanned. To overcome these challenges in user friendly way, this invention proposes the scanning of label being done keeping handset roughly parallel to label and acquire at least two color-profiles with mobile flash on and off. A genuine label with actual ORR (optical variable region) will auto-change its color profile depending on flash is ON or OFF. A duplicate version of label will maintain same color-profile. Another advantage of keeping handset parallel is that flash lighting angle remains same for registration & verification scans and effect of external lighting is minimized. It will be worthwhile to be mentioned that optical variable region can be achieved by various methods including as simple as IR (iridescent) film and this invention is not limited to any specific method of achieving color/optical variableness. Fig, 5 shows original label with optical variable region and spatial distribution of its color profile with respect to any external reference (001)with flash ON & flash off. However, in FIG. 5 the example label shown has optical variable region only in outer periphery in contrast to labels shown in Fig. 2 to FIG. 3, wherein optical variable region is on full area of label.

Another embodiment that can be exercised to enable optical random region with or without color variableness is applying label on packaging with uneven or curved surface. Label geometry (and, also color profile, if label is provided with ORR) depends on surface geometry. Spatial orientation of label depends on geometric relation with respect to external reference and change in spatial orientation of label will also change color-profile (if label is provided with ORR). This happens due to application of duplicate label (derived out of actual label image already applied on packaging with curved/uneven surface) again physically applied on same packaging and it can be additionally used to detect photocopy/scan version.

Figure 7:
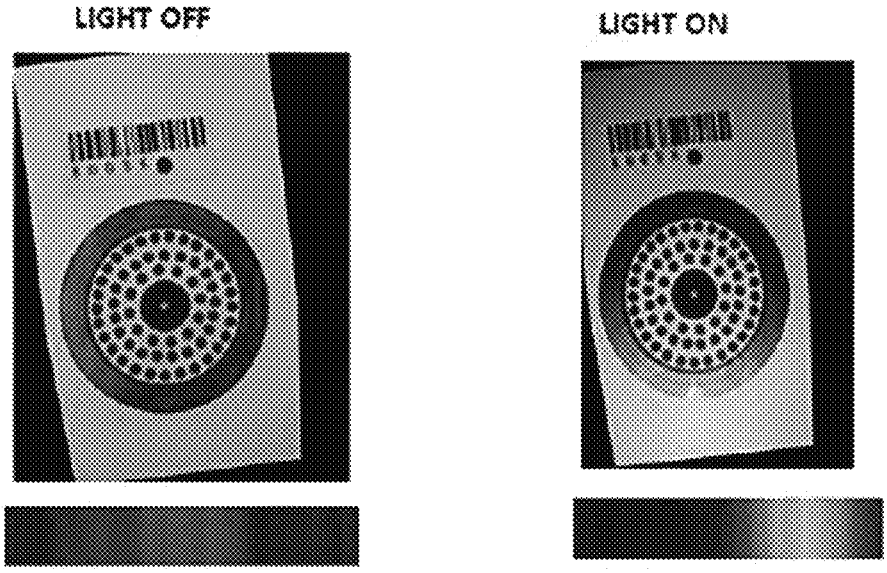
FIG. 7 shows imaging of original label wherein with light ON, portion of ORR region (in ring shape in periphery of label) gets darker.

Second simple embodiment that can be exercised and that will quickly detect if label is original or duplicate without requiring to match color- profile during verification scan with color profile (e.g., stored in cloud) acquired during registration scan. In this embodiment. smartphone (or scanning device) is kept tilted with respect to surface of label. In titled orientation flash light will be incident at an angle on optically variable region (IR—Iridescent) film. With flash ON, image portion of ORR is darkest and almost same portion of ORR will be brighter with light OFF scanning as shown in FIG. 7, Programmatic Comparison of darkest part of label ORR with flash ON compared for same portion of ORR with flash OFF determines whether label is original or duplicate. Second embodiment is pictorially captured in FIG. 7.

First and second embodiments can also be combined in multiple possible ways to execute forensic analysis in two step. For example, first step is to identify whether label is original as per second embodiment described in previous paragraph. Second step is to match color profile during registration and verification scan only with flash light ON condition. With flash light ON the effect of external lighting is minimized. In second embodiment with flash light ON and tilted scanning, the portion of label ORR becomes darker such that true color cannot be extracted. To mitigate this during color-profile matching, only those portions of label ORR is matched, which are above a threshold value of illumination.

The embodiments described here is only illustrative and invention is not limited by the description. A person having ordinary skill in prior-art will be able to exercise other obvious embodiments without undue experimentation. For example, color profiling capture and comparison is not limited to circular labels with or without external reference. To further illustrate, in one obvious embodiment, if label is non-circular with no external reference on packaging and device software draws an outline on screen such that label fits along outline in camera view at same place on screen and optionally an external reference on screen can be provided or can be just punch hole in surface or one more label or any other obvious derivations. Also, invention is not limited to specific method of recording spatial distribution of color profile. Similarly, light ON and light OFF conditions can be created by external lighting without necessarily using scanning device's flash light. Color profiling change can also be induced by variable positioning of label and/or lighting without necessarily making light OFF and light ON. Further color profiling change can also be induced by special illuminations like UV and/or TR or combination of these with normal lights. Similarly, software, cloud and database are not described in this invention in detail as these are well known and not to make this invention obscure. Further software, cloud and database details are not contextual to the core of this invention. All these derivations are well under scope of this invention.

Snap of optically variable label is always captured along with reference circle. Reference circle is used to determine spatial orientation of security label. Snap is always captured with a light homogenizer enclosure to protect the optical variableness from external lighting. If light homogenizer is fully opaque, it might need an internal lighting source. Color profiling of snaps captured at registration and verification time is compared. Color profiling is taken along virtual ring/path/contour (002 and 004) of specified thickness and distance from centre of label. However, important point is that color profiling always starts getting recorded from intersection point of line joining the reference circle (001) to centre of label. For color profiling, certain number of points on perimeter of ring is selected and on each point average color profile of small area (for example circle/square) symmetrically enclosing the point.

There is great importance of starting color profiling at intersection point (on ring circumference) of line joining the reference circle to centre of label. Tamper detection based on spatial orientation might fail, if hypothetically reference circle is tampered such that computation of spatial orientation of label is not affected, but then, also the color profiling of same genuine label even though not physically tampered will get changed indicating tampering. Color profiling of same label will be changed because intersection point on circumference of ring will be different with changed position of reference circle.

Inventive steps:

(a) Achieving per-piece uniqueness from spatial distribution of optical variableness with respect to external reference even though same label is applied and re-applied
(b) Achieving fully automated machine verification of optical variableness.
(c) Detection of tampering even though the security label with optical randomness is not tampered and only reference circle is tampered due to start of color profiling at intersection point (on circumference of ring) on line joining reference circle to centre of label
(d) Acquiring at least two color-profiles with flash ON & flash OFF. Change in color-profiling due to change in spatial orientation even though same label is reapplied.
(e) Change in color profile also detected when duplicate (photocopy/scan version) of original label is applied on packaging with curved/uneven surface applied on same packaging as label geometry changes and hence, spatial orientation also changes.
(f) It can be possible to alter the external reference in specific way such that spatial orientation computation for label is not changed, but still tampering is detected due to change in spatial distribution of color profile.

What is claimed is:

1. A method of determining authenticity or tampering of a security label, the method comprising:

obtaining, during registration, spatial distribution of color, relative to a determined reference, from the security label under a first lighting condition and a second lighting condition, wherein the first lighting condition is different from the second lighting condition;

obtaining, during verification, spatial distribution of color, relative to the determined reference, from the security label under the first lighting condition and the second lighting condition;

comparing spatial distribution of color obtained from the security label during registration and verification relative to the determined reference, wherein the determined reference is derived from at least a first reference that is part of the security label and at least a second reference that is external to the security label, wherein change in spatial distribution of color, in at least one of the lighting conditions, relative to the determined reference indicates tampering of the security label or breach in authenticity of the security label.

2. The method of claim 1, further comprising:

capturing, during registration, the spatial distribution of color along a predefined path relative to the determined reference; and capturing, during verification, the spatial distribution of color along the predefined path relative to the reference.

3. The method of claim 1, wherein the reference is derived, during registration and verification, by defining a virtual path between the first and the second references.

4. The method of claim 1, wherein the first reference is at the security label's centre and the second reference is on an object to which the security label is applied.

5. The method of claim 1, wherein the second reference is provided in a system that captures the spatial distribution of color.

6. The method of claim 1, wherein the capturing of the spatial distribution of color comprises capturing color profile at a plurality of areas, each of the areas enclose a point along a predefined path relative to the determined reference.

7. The method of claim 1, wherein the capturing of the spatial distribution of color comprises capturing color profile beginning from a predefined distance from an intersection between a virtual path defined between the first and the second references and a region in the security region comprising plurality of colors.

8. The method of claim 1, wherein the capturing of the spatial distribution of color is carried out under a light homogenizer.

9. The method of claim 1, further comprising applying the security label on a curvy or uneven surface, thereby ensuring that applying of a photocopied or a scanned version of the security label on the same surface results in difference in geometry of the photocopied or scanned version of the security label compared to the security label.

10. The method of claim 1, further comprising:

scanning the security label, during verification, while a device used for scanning is tilted with respect to surface of the security label; and verifying whether a portion of a region of the security label, comprising a plurality of colors distributed to define a color profile, is darker in an image captured when illuminated, or is darker in the image captured when illuminated as compared to an image captured when illumination is absent.

11. A system for automated verification of security labels, the system configured to:

capture, during registration, using at least one scanning device deployed at a location of registration, spatial distribution of color, relative to a determined reference, from the security label under a first lighting condition and a second lighting condition, wherein the first lighting condition is different from the second lighting condition;

capture, during verification, using at least one scanning device deployed at a location of registration, spatial distribution of color, relative to the determined reference, from the security label under the first lighting condition and the second lighting condition; and compare, using at least one processor, spatial distribution of color obtained from the security label during registration and verification relative to the determined reference, wherein the determined reference is derived from at least a first reference that is part of the security label and at least a second reference that is external to the security label, wherein change in spatial distribution of color, in at least one of the lighting conditions, relative to the determined reference indicates tampering of the security label or breach in authenticity of the security label.

12. The system for automated verification of security labels of claim 11 configured to compare the spatial distribution of color in the security label captured at a first instance with the spatial distribution of color in the security label captured at a second instance.

13. The system for automated verification of security labels of claim 11 configured to derive the determined reference by defining a virtual path between the first and the second references, wherein the system is configured to:

capture, during registration, the spatial distribution of color along a predefined path relative to the determined reference; and capture, during verification, the spatial distribution of color along the predefined path relative to the reference.

14. The system for automated verification of security labels of claim 11, wherein the second reference is located on screen of the scanning device.

* * * * *